US006494790B1

(12) United States Patent
Toyota et al.

(10) Patent No.: US 6,494,790 B1
(45) Date of Patent: Dec. 17, 2002

(54) GOLF CLUB HEAD

(75) Inventors: Masayuki Toyota, Kagawa-ken (JP); Kenichi Sato, Kagawa-ken (JP)

(73) Assignee: Kasco Corporation, Okawa-gun (JP)

( * ) Notice: Subject to any disclaimer, the term of this patent is extended or adjusted under 35 U.S.C. 154(b) by 0 days.

(21) Appl. No.: 09/522,791

(22) Filed: Mar. 7, 2000

(51) Int. Cl.[7] ..... A63B 53/04
(52) U.S. Cl. ..... 473/345; 473/349; 473/350
(58) Field of Search ..... 473/324, 328, 473/345, 348, 349, 350

(56) References Cited

U.S. PATENT DOCUMENTS 5,547,188 A * 8/1996 Dumontier et al. ..... 473/324 X
5,630,888 A * 5/1997 Yoshida et al. ..... 473/324 X
5,935,020 A * 8/1999 Stites et al. ..... 473/345
6,048,278 A * 4/2000 Meyer et al. ..... 473/345
6,146,286 A * 11/2000 Masuda ..... 473/345 X

OTHER PUBLICATIONS

Kasco "CLUB" 1999 Autumn & Winter Golf Club Catalog, Jul. 1999, cover page and pages identifying Power Tornado 44 "Get the Max Distance", Power Tornado 1, Power Tornado 44, Super Hyten VS Force, Shockless Steel VS Force, Big Super Hyten VS Force 02 and KS–Iron SS–02 (on the same page), and last page setting forth Kasco's telephone and fax numbers and the date "1999.7".

* cited by examiner

*Primary Examiner*—Raleigh W. Chiu
(74) *Attorney, Agent, or Firm*—Frishauf, Holtz, Goodman & Chick, P.C.

(57) ABSTRACT

A golf club head includes a face having a height ranging from 24 to 32 mm. The ratio W/H of the width W of a sole to the height H of the face is in the range from 1.5 to 2.2. The distance Y from a straight line along the central axis of a hosel to the end of a heel is in the range from 11 to 15 mm. The golf club head thus constructed is capable of hitting the ball over a sufficient distance in a good direction.

18 Claims, 1 Drawing Sheet

GOLF CLUB HEAD

BACKGROUND OF THE INVENTION

1. Field of the Invention

The present invention relates to a golf club head having a hollow structure, and more particularly to the head of a golf club for use as a fairway wood or a long iron.

2. Description of the Related Art

In recent years, hollow metallic golf club heads are mainly used as the heads of wood golf clubs such as drivers. A golf club with a hollow metallic head is advantageous in that it can deliver the ball over a larger distance in a more correct direction. With the hollow metallic head, its crown and side can be thin-walled to give much weight to at least a portion of the sole, and the center of gravity can be lowered and positioned rearwardly away from the face without causing an increase in the overall weight of the head. The lowered and rearwardly positioned center of gravity is effective to prevent the ball from going upwardly due to an excessive back spin, but to allow the ball to follow an ideal trajectory for traveling a sufficient distance. Because of the hollow structure, the club head has a relatively large moment of inertia and hence can hit the ball in a good direction.

There is known a wood club head having a face whose height is reduced for a low center of gravity. Specifically, since a golf club head with a low center of gravity is ideal for hitting the ball at a sweet spot for a fairway shot, many fairway wood club heads have a face with a reduced height. Golf club heads having a face with a reduced height can have its center of gravity lowered by positioning a sweet spot, which is at the foot of a perpendicular from the center of gravity of the head to the face, near the center of the face. If the center of gravity of a golf club head having a face with a large height is to be lowered, then the sweep spot is largely displaced downwardly on the face, resulting in a poor vertical balance of the head.

Wood golf club heads that have been available heretofore are preferable if they can hit the ball over a large distance in a good direction, have a sole whose area of contact with ground is small when hitting the ball, and allow the golf club user to perform a smooth transition from the downswing phase to the follow-through phase. Particularly, it is important for fairway wood golf clubs to have a sole configuration with a small area of contact with ground because they are used almost exclusively to hit the ball from a fairway or a rough area unlike drivers that are used to make a tee shot. It is therefore customary for fairway wood golf clubs to have a slanted or curved sole.

Though metallic wood golf club heads, particularly fairway wood golf club heads, are capable of hitting the ball over a large distance with the lowered center of gravity and allowing the golf player to perform a smooth transition action from the downswing phase to the follow-through phase with the shaped sole, they have much to be improved and should desirably be stabler with respect to the directivity of the shot.

The directivity of the shot is better as the club head has a larger moment of inertia. If the club head does not easily turn back when hitting the ball, then the hit ball will travel in a wrong direction. Conventional fairway wood golf clubs are problematic in that their head does not turn back well because the face tends to be in an open position with respect to the ball when hitting the ball.

SUMMARY OF THE INVENTION

It is a general object of the present invention to provide a golf club head which is capable of hitting the ball over a long distance in a good direction.

Another object of the present invention is to provide a golf club head which prevents the ball from going upwardly.

Still another object of the present invention is to provide a golf club head which allows the golf club user to perform a smooth transition from the downswing phase to the follow-through phase.

Yet another object of the present invention is to provide a golf club head which can easily turn back when hitting the ball.

According to the present invention, a golf club head of hollow structure has a head body having a heel, a toe, and a face extending between the heel and the toe, a sole connected to the head body and extending rearwardly from the face, and a hosel extending from the head body, the face having a height H ranging from 24 to 32 mm, the sole having a width W, the ratio W/H of the width W to the height H being in the range from 1.5 to 2.2, and the distance Y from a straight line along the central axis of the hosel to the end of the heel being in the range from 11 to 15 mm.

Since the height H and the ratio W/H of the width W to the height H are specified and the position of the hosel with respect to the face is also specified as described above, the golf club head can turn back well when hitting the ball and make the ball stable in its direction of travel.

The sole is curved to reduce its area of contact with ground for allowing the golf club user to perform a smooth transition from the downswing phase to the follow-through phase. The height of the face is reduced to lower the center of gravity of the golf club head for delivering the ball over a sufficient distance in a stable direction.

The sole is partly increased in thickness to provide a concentrated-weight portion which is located in an appropriate position and has appropriate width and weight. The concentrated-weight portion of the sole makes the golf club head capable of hitting the ball over a long distance in a good direction.

The head body has a height H ranging from 24 to 32 mm along the face. In order for the face to hit the ball on ground at its sweet spot that is positioned near the center of the face, the height H is about 33 mm or less. If the height H is smaller than 24 mm, however, the area of the face that is effective to hit the ball is too narrow.

The face has a length L ranging from 80 to 100 mm. If the length L were in excess of 100 mm, then since the shape of the face would be too different from the conventional shapes, the golf club user would tend to produce a wrong shot. If the length L were smaller than 80 mm, then the moment of inertia of the golf club head would be so reduced that the golf club user would fail to hit the ball in a good direction.

The ratio W/H ranges from 1.5 to 2.2, preferably from 1.7 to 2.0. The ratio W/H is set to a relatively small value in order to reduce the width W of the sole. However, if the ratio W/H were less than 1.5, then the golf club head would not turn back sufficiently when hitting the ball, and would not hit the ball in a stable direction. If the ratio W/H exceeded 2.2, then the golf club head would turn back excessively and might make unstable the direction of travel of the ball which has been hit.

The distance Y is in the range from 11 to 15 mm, preferably from 12 to 15 mm. The distance Y thus selected positions a shaft mounted in the hosel closely to the center of gravity of the golf club head, making stable the direction of travel of the ball which has been hit. If the distance Y were less than 11 mm or equal to or greater than 16 mm, then the ball would be hit in an unstable direction.

The golf club head may have a volume of at most 170 cc, and a lie angle α ranging from 56 to 60°. If the height H and the length L and the relationship between the width W and the height H are specified as described above, then the volume of the golf club head which is 170 cc or less is appropriate. If the lie angle α were less than 56°, then since a relatively long shaft is mounted on the golf club head, the face of the golf club head would be liable to be in an open position when hitting the ball. If the lie angle α were in excess of 60°, then since a relatively short shaft is mounted on the golf club head, the golf club head would be apt to fail to deliver the ball over a long distance.

The hosel may have a shaft receiving hole defined therein and open at the sole. The shaft receiving hole is also referred to as a through bore, which is known as easily making low the center of gravity of the golf club head. In-as-much as the hosel is relatively spaced apart from the end of the heel, the through bore defined in the hosel is effective to make the golf club head heavier at the heel, so that the golf club head can turn back easily when hitting ball.

The sole extends from the toe to the heel and has a radius R of curvature of at most 110 mm. However, it is not necessary for the sole have a curved surface having a single radius of curvature, but may have a curved surface having different radii of curvature. The radius R of curvature is preferably in the range from 60 to 100 mm, and more preferably in the range from 70 to 90 mm. If the radius R of curvature were too small, then the size of the golf club head would be too small, and the moment of inertia thereof would be too small, making poor the directivity of the ball which has been hit. If the radius R of curvature were larger than 110 mm, then the size of the golf club head would be too large, and the sole would have too a large area of contact with ground, so that the ability of the golf club head to make a smooth transition from the downswing phase to the follow-through phase would be reduced.

The concentrated-weight portion which has an increased wall thickness and is located at a rear position spaced from the face. The concentrated-weight portion has a width Z which is at most ½, preferably in the range from ⅕ to ½, of the width W of the sole, and a weight ranging from 40 to 100 g, preferably from 50 to 80 g. The concentrated-weight portion thus constructed allows the golf club head to have its center of gravity effectively lowered and positioned rearwardly without losing an adequate weight balance. If the width Z of the concentrated-weight portion were more than ½ of the width W of the sole, or the weight of the concentrated-weight portion were less than 40 g, then it would be difficult to lower and position rearwardly the center of gravity of the golf club head. The concentrated-weight portion may be positioned in an entire rear region of the sole at maximum.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
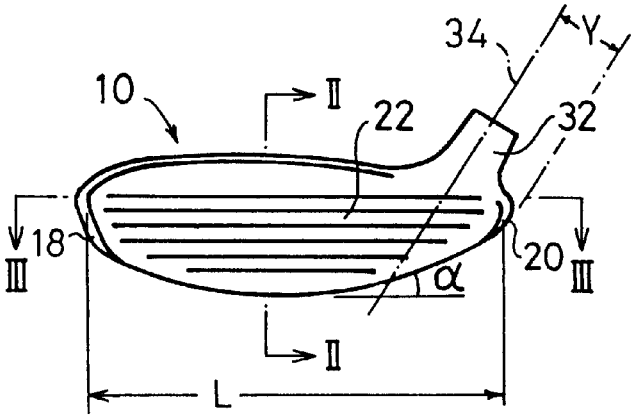
FIG. 1 is a front elevational view of a golf club head according to the present invention.
Figure 2:
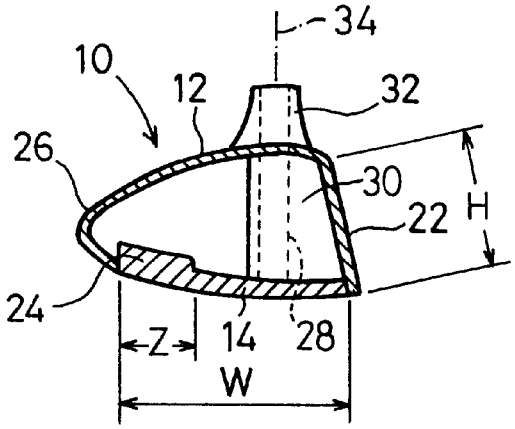
FIG. 2 is a cross-sectional view taken along line II—II of FIG. 1.
Figure 3:
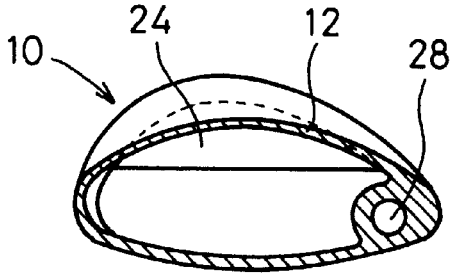
FIG. 3 is a cross-sectional view taken along line III—III of FIG. 1.

As shown in FIGS. 1 through 3, a golf club head 10 according to the present invention comprises a head body 12 and a sole 14 (see FIG. 2) which are joined to each other by welding or the like.

The head body 12 is made of maraging steel containing 12.5 weight % of Cr, 4.5 weight % of Ni, 5.0 weight % of Mo, and 12.5 weight % of Co, and the sole 14 is made of SUS 630 stainless steel. Both the head body 12 and the sole 14 are formed by precision casting.

As shown in FIGS. 1 and 2, the sole 14 has a curved outer surface which extends from a toe 18 to a heel 20 of the golf club head 10 and whose radius R of curvature may be 110 mm or less. In the illustrated embodiment, the radius of curvature is 80 mm.

As shown in FIGS. 2 and 3, the sole 14 has a concentrated-weight portion 24 with an increased wall thickness at a rear position within the golf club head 10 which is spaced apart from a front face 22 of the head body 12. The concentrated-weight portion 24 has a width Z in a direction from the front side to the rear side of the golf club head 10, the width Z being one-half or less of the width W of the sole 14 in the direction from the front side to the rear side of the golf club head 10. The width Z ranges from 10 to 29 mm, and the width W ranges from 40 to 58 mm. The concentrated-weight portion 24 has a weight ranging from 40 to 100 g.

In an example, the weight of the concentrated-weight portion 24 was 50 g, the width Z was 14 mm, and the width W was 53 mm. In another example, the weight of the concentrated-weight portion 24 was 70 g, the width Z was 20 mm, and the width W was 48 mm.

The weight of the concentrated-weight portion 24 can be confirmed by calculating the same from the area and thickness of the concentrated-weight portion 24 in the sole 14 and the specific gravity of the material of the concentrated-weight portion 24. The thickness of the concentrated-weight portion 24 may be in the range from 4 to 10 mm, and the thickness of the sole 14 except the concentrated-weight portion 24 may be in the range from 1 to 6 mm.

As shown in FIG. 2, the head body 12 has a height H ranging from 24 to 32 mm along the face 22. As shown in FIG. 1, the face 22 has a length L ranging from 80 to 100 mm from the toe 18 to the heel 20. In an example, the height H was 30 mm and the length L was 98 mm. In another example, the height H was 27 mm and the length L was 90 mm.

The ratio W/H of the width W of the sole 14 to the height H of the face 22 is in the range from 1.5 to 2.2. In the example where the height H was 30 mm and the length L was 98 mm and also in the example where the height H was 27 mm and the length L was 90 mm, the ratio W/H was about 1.8.

The golf club head 10 has a hollow hosel 32 extending obliquely upwardly from the head body 12. The distance Y from a straight line 34 along the central axis of the hollow hosel 32 to the end of the heel 20 is in the range from 11 to 15 mm. In the example where the height H was 30 mm and the length L was 98 mm, the distance Y was about 13 mm. In the example where the height H was 27 mm and the length L was 90 mm, the distance Y was about 12 mm.

The golf club head 10 has a volume of 170 cc or less. In the example where the height H was 30 mm and the length L was 98 mm, the volume of the golf club head 10 was 130 cc. In the example where the height H was 27 mm and the length L was 90 mm, the volume of the golf club head 10 was 80 cc. The golf club head 10 has a lie angle a ranging from 56 to 60°. In the example where the height H was 30 mm and the length L was 98 mm, the lie angle α was 57.5°. In the example where the height H was 27 mm and the length L was 90 mm, the lie angle a was 59.5°.

The overall weight of the golf club head 10 is in the range from 190 to 235 g. The thickness of the face 22 is in the range from 2.0 to 2.5 mm. The thickness of the crown 26 except the face 22 is in the range from 0.5 to 1.0 mm.

The numerical values of the various parts of the golf club head may be selected within the above ranges.

As shown in FIG. 2, the head body 12 and the sole 14 are interconnected by a column 30 extending from the head body 12. The column 30 has a shaft receiving hole 28 referred to as a through bore which extends coaxially into the hollow hosel 32 and is open at the sole 14. The through bore in the column 30 is effective to lower the center of gravity of the golf club head 10. The hollow hosel 32 is so short that the center of gravity of the golf club head 10 is not elevated in position. In this manner, the center of gravity of the golf club head 10 is lowered.

In the golf club head 10 of hollow structure, the height and length of the face 22 are specified, and the relationship between the height of the face 22 and the width of the sole 14 and the position of the hollow hosel 32 with respect to the longitudinal direction of the golf club head 10 are optimized for allowing the golf club head 10 to turn back well when hitting the ball to stabilizing the directivity of the ball which has been hit.

The sole 14 is curved to reduce its area of contact with ground for allowing the golf club user to perform a smooth transition from the downswing phase to the backswing phase. The height of the face 22 is reduced to lower the center of gravity of the golf club head 10 for delivering the ball over a sufficient distance.

The sole 14 is partly increased in thickness to provide the concentrated-weight portion 24 integral therewith which has appropriate weight and width and is located in an appropriate position. The center of gravity of the golf club head 10 can thus be lowered and positioned rearwardly for allowing the golf club user to deliver the ball over an increased distance. The moment of inertia of the golf club head 10 can be increased to stabilizing the direction of travel of the ball which has been hit.

Although a certain preferred embodiment of the present invention has been shown and described in detail, it should be understood that various changes and modifications may be made therein without departing from the scope of the appended claims.

What is claimed is:

1. A golf club head of hollow structure comprising:

a head body having a heel, a toe, and a face extending between said heel and said toe;

a sole connected to said head body and extending rearwardly from said face; and a hosel extending from said head body;

wherein said face has a height H ranging from 24 to 32 mm, said sole has a width W, a ratio W/H of said width W to said height H is in a range from 1.5 to 2.2, and a distance Y from a straight line along a central axis of said hosel to an end of said heel is in a range from 11 to 15 mm.

2. A golf club head according to claim 1, wherein said face has a length L ranging from 80 to 100 mm.

3. A golf club head according to claim 1, wherein said sole extends from said toe to said heel and has a radius R of curvature of at most 110 mm.

4. A golf club head according to claim 3, wherein said radius R of curvature ranges from 60 to 100 mm.

5. A golf club head according to claim 3, wherein said radius R of curvature ranges from 70 to 90 mm.

6. A golf club head according to claim 1, wherein said sole has a concentrated-weight portion with an increased wall thickness at a rear position spaced from said face, said concentrated-weight portion having a width Z rearwardly from said face, said width Z being at most one-half of the width W of said sole, and said concentrated-weight portion having a weight ranging from 40 to 100 g.

7. A golf club head according to claim 6, wherein said width Z ranges from ⅕ to ½ of said width W.

8. A golf club head according to claim 6, wherein said weight of said concentrated-weight portion ranges from 50 to 80 g.

9. A golf club head according to claim 1, wherein said ratio W/H ranges from 1.7 to 2.0.

10. A golf club head according to claim 1, wherein said distance Y ranges from 12 to 15 mm.

11. A golf club head according to claim 1, wherein said golf club head has a volume of at most 170 cc.

12. A golf club head according to claim 1, wherein said golf club head has a lie angle ranging from 56 to 60°.

13. A golf club head according to claim 1, wherein said hosel has a shaft receiving hole defined therein and open at said sole.

14. A golf club head according to claim 1, wherein said head body is made of maraging steel containing 12.5 weight % of Cr, 4.5 weight % of Ni, 5.0 weight % of Mo, and 12.5 weight % of Co.

15. A golf club head according to claim 1, wherein said sole 14 is made of SUS 630 stainless steel.

16. A golf club head of hollow structure comprising:

a head body having a heel, a toe, and a face extending between said heel and said toe;

a sole connected to said head body and extending rearwardly from said face; and a hosel extending from said head body;

wherein said sole has a concentrated-weight portion with an increased wall thickness at a rear position spaced from said face, said concentrated-weight portion has a width Z rearwardly from said face, said width Z is at most one-half of a width W of said sole, and said concentrated-weight portion has a weight ranging from 40 to 100 g.

17. A golf club head according to claim 16, wherein said width Z ranges from ⅕ to ½ of said width W.

18. A golf club head according to claim 16, wherein said weight of said concentrated-weight portion ranges from 50 to 80 g.

* * * * *